United States Patent [19]

Kaim

[11] 4,363,414

[45] Dec. 14, 1982

[54] TYPE-E RAILROAD CAR COUPLER HEAD

[75] Inventor: John W. Kaim, Chicago, Ill.

[73] Assignee: AMSTED Industries Incorporated, Chicago, Ill.

[21] Appl. No.: 209,896

[22] Filed: Nov. 24, 1980

[51] Int. Cl.[3] ..... B61G 3/004

[52] U.S. Cl. ..... 213/147; 213/146

[58] Field of Search ..... 213/147, 145, 139, 148, 213/146, 127

[56] References Cited

U.S. PATENT DOCUMENTS

| | | | |
|---|---|---|---|
| 974,154 | 11/1940 | Janney | 23/147 X |
| 2,350,470 | 6/1944 | Metzger | 213/146 |
| 2,568,312 | 9/1951 | Wolfe | 213/148 |
| 2,585,889 | 2/1952 | Wolfe | 213/148 |
| 2,585,958 | 2/1952 | Metzger | 213/146 |
| 2,866,560 | 12/1958 | Metzger | 213/148 |
| 2,919,038 | 12/1959 | Metzger | 213/148 |
| 3,433,369 | 3/1969 | Metzger et al. | 213/148 |
| 3,549,021 | 12/1970 | Metzger | 213/148 X |
| 3,698,570 | 10/1972 | Metzger | 213/127 |
| 3,850,312 | 11/1974 | Baker, Sr. | 213/147 |
| 3,853,228 | 12/1974 | Metzger | 213/147 X |
| 4,084,705 | 4/1978 | Oshinsky et al. | 213/145 X |

*Primary Examiner*—Joseph F. Peters, Jr.
*Assistant Examiner*—M. J. Hill
*Attorney, Agent, or Firm*—Tony T. Shu; Fred P. Kostka; Edward J. Brosius

[57] ABSTRACT

A railroad car coupler includes a Type-E coupler head which contains a vertical lock chamber. Disposed in the chamber is a lock which may be raised from a lower locking position to an intermediate lockset position. At lockset, a knuckle pivotally carried by the coupler head may swing from a closed position to an open position. At lockset, the lock rests on a knuckle thrower of the coupler head with a lockset seat of the lock engaging a leg lock seat portion of the knuckle thrower. By forming the lockset seat of the lock on a selective lateral slope, the lock may be tilted toward a guard arm side of the coupler head. When the knuckle is swung toward its open position, a sufficient area of a tail portion of the knuckle passes under the lock to insure a proper pick-up of the lock to remove the lock from lockset.

3 Claims, 7 Drawing Figures

TYPE-E RAILROAD CAR COUPLER HEAD

BACKGROUND OF THE INVENTION

1. Field of the Invention

This invention relates to railroad car couplers and more particularly to couplers having the Type-E coupler head.

2. Prior Art

Railroad car couplers having a Type-E or Type-F coupler head are in common use today. Each coupler head type has been approved by the AAR (Association of American Railroads) wherein the couplers are assembled from standard components. The use of standard components allows the railroads to purchase couplers and related replacement parts from several manufacturers with assurance that such parts can be used interchangeably.

The standard Type-E coupler is disclosed in detail in U.S. Pat. Nos. 3,850,312 and 3,853,228, for example. The 3,850,312 patent suggests the use of an extended lockset seat on the lock of the coupler which relocates a center of gravity of the lock to improve lock rotation. The 3,853,228 patent discloses an improvement to the E-type coupler operation obtained by restricting movement of the knuckle thrower. Additionally, the 1974 Edition of Car and Locomotive Cyclopedia of American Practices, compiled and edited for the AAR by Simmons-Boardman Publishing Corporation, New York, N.Y., is an excellent source of detailed information on the AAR standard couplers and related nomenclature.

In spite of its long and continuous use, the Type-E coupler is not free of operating problems. For example, when the coupler head lock is placed in its lockset position, the knuckle may fail to open to release a second coupler mated thereto. This failure in operation can create a dangerous condition since the unreleased knuckle may transfer draft forces to cause movement of its respective railroad car or a further car to which that car is joined.

SUMMARY OF THE INVENTION

A lock of a Type-E coupler head is carried in a vertical lock chamber formed within the head. With a knuckle of the coupler head in a closed position, the lock may be dropped to its lowermost position within the lock chamber to prevent knuckle movement. Additionally, the lock may be raised to an intermediate position known as lockset. At lockset, the lock is maintained above a tail portion of the knuckle to allow the knuckle to swing to its open position.

At lockset, the position of the lock is maintained by engagement of a lockset seat of the lock with a leg lock seat of a knuckle thrower in the coupler head. By dividing the lockset seat of the lock laterally into portions and forming a guard arm side portion with an outward and upward slope, the lock may be tilted toward the guard arm side of the coupler head. The slope of the guard arm side portion of the lockset seat of the lock is sufficient to offset a reverse slope of the leg of the knuckle thrower which supports the lock.

Tilting the lock in its lockset position as noted above provides several advantages not heretofore known.

First, a lower knuckle side edge of a knuckle shelf seat of the lock is raised in proximity to an upper edge of a top surface of the knuckle tail portion. This increase in relative elevation insures that when the knuckle swings toward its open position, the knuckle tail portion edge passes uninterrupted under the lower lock edge. Contact between the knuckle tail portion and lock is delayed until there is sufficient area of the knuckle tail portion under the lock to support the lock. As is well known, at this point the lock is lifted from lockset and supported by the knuckle tail portion. If the area for support were not sufficient, the lock could inadvertently drop to its locking position.

Secondly, tilting the lock toward the guard arm side of the coupler head increases a space between the lock and knuckle tail portion. By increasing the space, a small movement of the knuckle will not result in the knuckle tail portion contacting the lock. Such contact could dislodge the lock from lockset wherein the lock would drop to its locking position in the lock chamber. Thus, by increasing the space between the knuckle tail portion and the lock as well as increasing the relative height of the lower edge of the lock with respect to the knuckle tail portion, the operating difficulty noted above is substantially eliminated.

As an additional benefit, the lock is also easier to fabricate. The lock being cast should include surfaces with a draft to allow ready removal from its mold set. The sloped portion of the lockset seat of the lock is correctly drafted to promote release of the lock.

DESCRIPTION OF THE PREFERRED EMBODIMENT

A Type-E railroad car coupler head is shown generally in FIGS. 1–4 and designated 10. The coupler head 10 is carried at the end of an elongated shank 12 shown in part. The shank 12 would be connected to a body of a railroad car (not shown) in a known manner.

Figure 1:
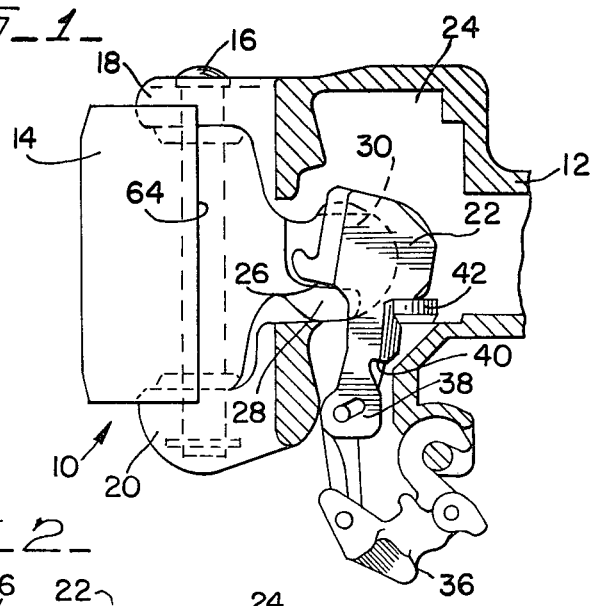
FIG. 1 is an elevational view in cross section of a Type-E railroad car coupler head with a knuckle of the coupler head closed and locked.

The coupler head 10 includes a knuckle 14 pivotally carried on a pin 16 which in turn is supported between spaced upper and lower lugs 18, 20. As seen in FIG. 1, the knuckle 14 is in a closed and locked position. In this position, movement of the knuckle 14 is inhibited by interference with a lock 22 carried within a vertical lock chamber 24 formed within the coupler head 10. As shown the lock 22 is in a lowermost position within the chamber 24.

Figure 4:
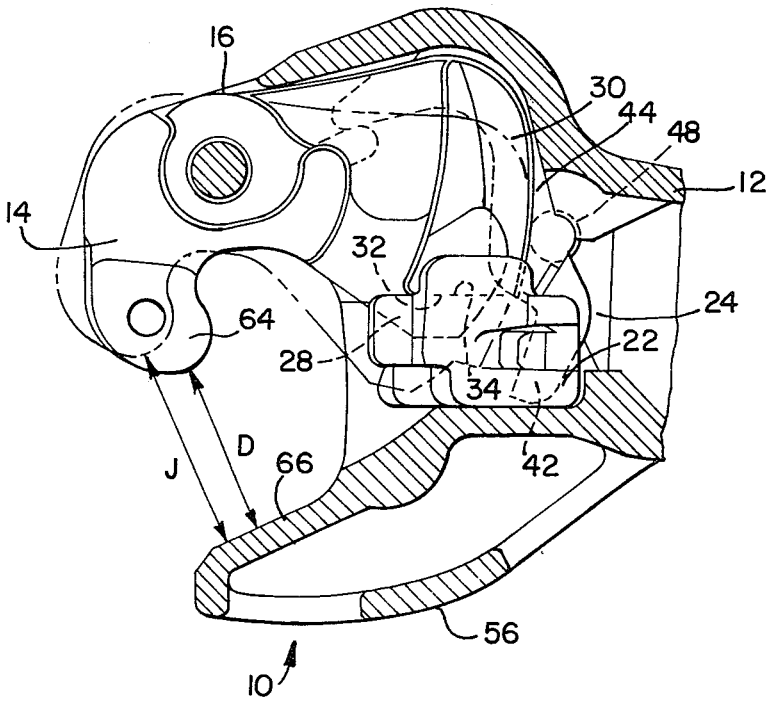
FIG. 4 is a plan view in cross section of the coupler head as seen generally along the line 4—4 of FIG. 2 showing lock in a tilt position.

In this lowermost locking position, a knuckle shelf seat 26 of the lock 22 rests on a lock shelf 28 formed as part of a tail portion 30 of the knuckle 14. As best seen in FIG. 4, the tail portion 30 is located substantially within the coupler head 10. The knuckle tail portion 30 has a vertical locking face 32 which is located to engage a locking face 34 of the lock 22 to prevent rotation of the knuckle 14 from its closed position.

Figure 2:
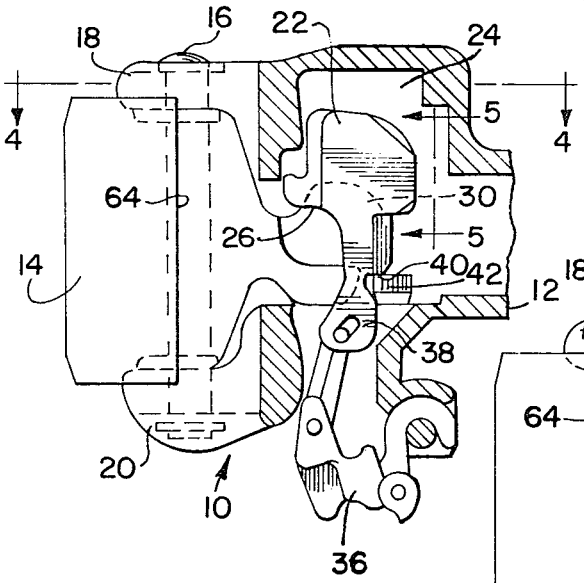
FIG. 2 is an elevational view in cross section of the coupler head of FIG. 1 wherein the knuckle remains closed but is not locked in that a lock of the coupler head has been placed in its lockset position.
Figure 3:
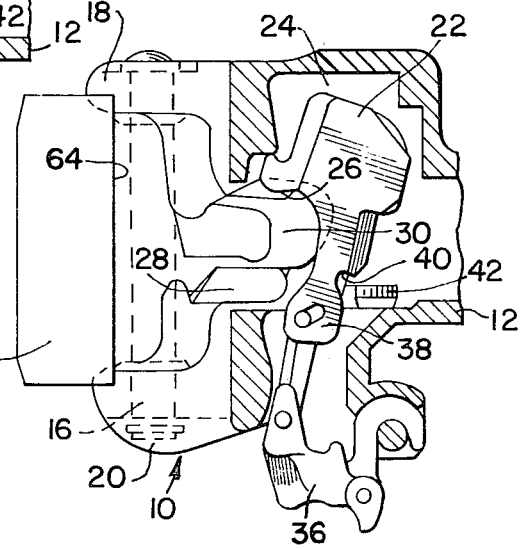
FIG. 3 is an elevational view in cross section of the coupler head of FIG. 1 wherein the knuckle has moved toward its open position and as a result the lock has been lifted from its lockset position.
Figure 5:
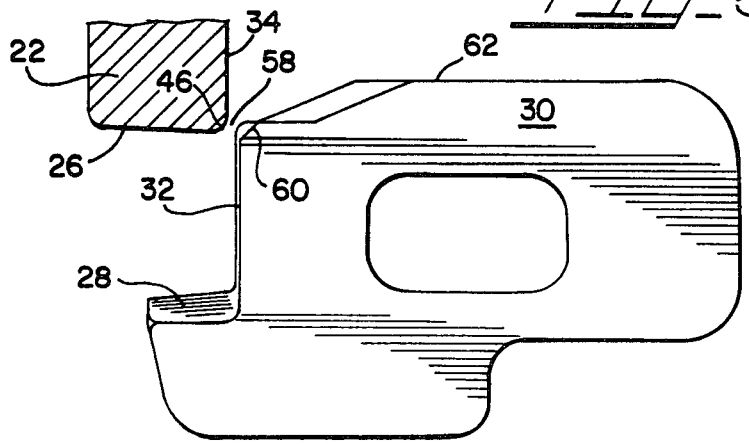
FIG. 5 is a simplified elevational view showing the relationship of a portion of the lock to a tail portion of the knuckle as seen generally along the line 5—5 of FIG. 2.

As seen in FIGS. 2 and 5, the lock 22 has been raised to its lockset position by a lock lift assembly 36. The assembly 36 comprises a series of joined links which connect with a leg 38 of the lock 22. The leg 38 of the lock 22 includes a lockset seat 40 which engages a leg lock seat portion 42 of a knuckle thrower 44 to support the lock 22. In the lockset position, the lock 22 is raised sufficiently to allow the knuckle tail portion 30 of the knuckle 14 to swing under a lower knuckle side edge 46 formed at a joinder of the knuckle shelf seat 26 and the locking face 34 of the lock 22.

Figure 6:
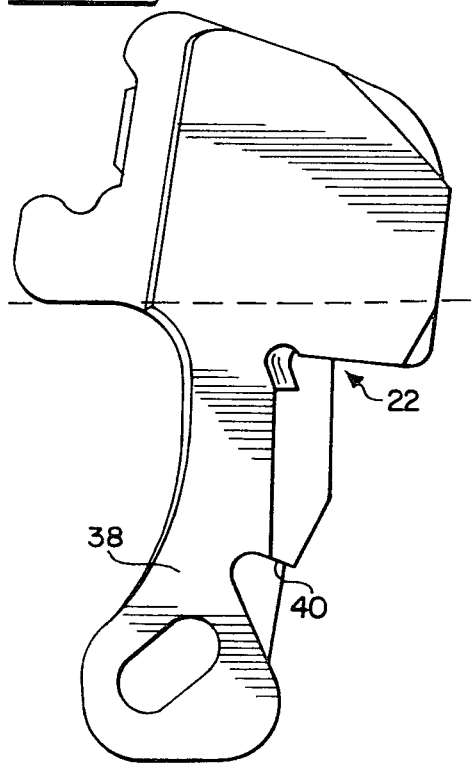
FIG. 6 is a guard arm side elevational view of the lock used in the coupler of FIGS. 1–4.
Figure 7:
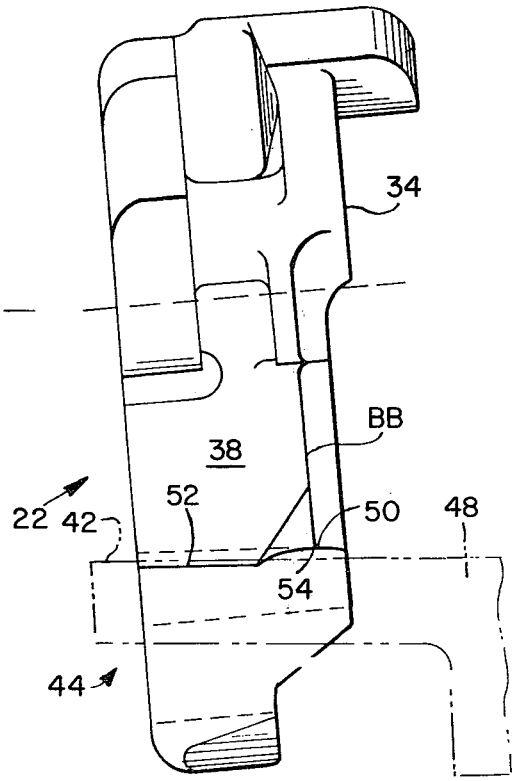
FIG. 7 is a simplified rear elevational view of the coupler head lock in the tilt position as engaged with a knuckle thrower of the coupler head.

Note that the lockset seat 40 of the lock 22 is longitudinally downwardly and inwardly sloped, i.e. toward the knuckle thrower 44, as best seen in FIG. 6. This configuration helps to maintain the lockset seat 40 on the leg lock seat 42 of the thrower 44. As shown in FIG. 7, the thrower leg 42 has a slight upward slope from its trunnion pin 48.

The lockset seat 40 of the lock 22 is divided into knuckle side portion 50 and a guard arm side portion 52. The guard arm side portion 52 laterally is upwardly and outwardly sloped from a point 54 at which the two portions 50, 52 join.

The lock 22 is fabricated by casting. A cope and drag form a mold set in which the lock 22 is cast. The point 54 is located to substantially align with a parting line B—B formed by the mold set parts. Thus, the sloped guard arm portion 52 provides a desired draft to promote removal of the lock 22 from the mold set.

The point 54 also lies on the knuckle side of a center of gravity of the lock 22. Thus, when the lockset seat 40 of the lock 22 engages the leg lock seat 42 of the knuckle thrower 44, the engagement is substantially limited to the guard arm portion 52 of the lockset seat 40. The slope of the guard arm portion 52 is sufficient to offset the slope of the thrower leg lock seat 42. As seen in FIG. 7, the lock 22, therefore, is slightly tilted toward a guard arm side portion 56 of the coupler head 10.

This guard arm tilt of the lock 22 produces a space 58 between the lower knuckle side edge 46 of the lock 22 and an upper knuckle tail portion edge 60 defining a joinder of an upper surface 62 of the knuckle tail portion 30 and the knuckle tail portion locking face 32. This space 58 insures that a slight movement of the knuckle 14 will not result in contact between the knuckle tail portion 30 and the lock 22. Such contact could jar the lock 22 from its lockset position wherein the lock 22 would drop to its locking position as seen in FIG. 1.

When the knuckle 14 is in its closed position, i.e. the knuckle 14 defined by solid lines in FIG. 4, a nose 64 of the knuckle 14 is a distance D from a guard arm face 66 of the coupler head 10. Under AAR standards, the distance D must proximate $4\frac{5}{8}$ inches. As the knuckle 14 swings toward its open position, the nose 64 of the knuckle 14, i.e. the knuckle 14 defined by broken lines in FIG. 4, should be a distance J from the guard arm face 66 before contact is made between the knuckle shelf seat 26 of the lock 22 and the upper surface 62 of the knuckle tail portion 30. Upon contact, the knuckle tail portion 30 lifts the lock 22 from its lockset position. AAR standards set this distance J between $5\frac{1}{4}$ and 6 inches wherein the knuckle 14 has rotated proximately 12 degrees. The guard arm tilt of the lock 22 raises the lower edge 46 of the lock 22 with respect to the upper edge 60 of the knuckle tail portion 30 insuring that the contact noted above is not premature. Thus, upon contact between the knuckle tail portion upper surface 62 and the knuckle shelf seat 26 of the lock 22, there is sufficient area of the knuckle tail portion upper surface 62 under the lock 22 to properly support such.

While various modifications may be suggested by those versed in the art, it should be understood that I wish to embody within the scope of the patent warranted hereon all such modifications as reasonably and properly come within the scope of my contribution to the art.

What is claimed is:

1. In a railroad coupler having a coupler head having a guard arm side and a knuckle side including a knuckle swingable about a vertical axis, a tail portion extending from said knuckle, a coupler lock positioned within a vertical lock chamber formed within said coupler head between said guard arm side and said knuckle side, said coupler lock being movable within said chamber from a locking position wherein said lock is in the path of movement of said tail portion knuckle to maintain said knuckle in a closed position, a knuckle thrower having a leg lock seat, said lock having a lock set seat in engagement with said knuckle leg lock seat when moved to an unlocked position whereby said knuckle is free to swing toward an open position, the improvement comprising, said lockset seat of said lock being divided laterally into a guard arm side portion and a knuckle side portion, said guard arm side portion being laterally sloped to engage with said knuckle thrower leg lock seat to tilt said lock toward said guard arm side of said coupler head thereby to minimize the spacing between said lock and said knuckle tail portion and reduce inadvertent contact between said lock and said knuckle tail portion.

2. A coupler for a railroad car comprising, a Type-E coupler head, a swingable knuckle attached by a pivot pin carried by spaced lugs formed as part of said coupler head, a vertical lock chamber formed within said coupler head with a tail portion of said knuckle disposed within said chamber and horizontally rotatable therein, a knuckle thrower pivotally carried within said coupler head adjacent to a lock chamber on a side opposite said knuckle tail portion, a lock disposed within said lock chamber and including a lockset seat for engagement at a lockset position with a leg lock seat of said thrower, said lockset seat of said lock being laterally sloped to place said lock in an out-of-square position with respect to said thrower leg lock seat to raise a lower knuckle side edge of said lock with respect to an upper knuckle tail portion edge of said knuckle tail portion, wherein at said lockset position as said knuckle swings from a closed position toward an open position, a sufficient area of an upper surface of said knuckle tail portion passes under a knuckle shelf seat of said lock to support said lock upon said upper surface of said knuckle tail portion contacting said lock knuckle shelf seat to lift said lock from said lockset position.

3. A coupler as defined by claim 2 and further characterized by, said lockset seat of said lock being divided into a guard arm side portion and a knuckle side portion, said portions joining at a point located between a vertical plane passing through a center of gravity of said lock and a knuckle side portion of said lock, said guard arm side portion being selectively upwardly and outwardly sloped, wherein said guard arm side portion of said lockset seat of said lock engages said thrower leg lock seat when said lock is at said lockset position with said lock being tilted toward a guard arm side of said coupler.

* * * * *